United States Patent [19]

Larsen et al.

[11] 4,016,992

[45] Apr. 12, 1977

[54] LIFT TRUCK WITH ROTATABLE LOAD-HANDLING APPARATUS

[75] Inventors: Richard L. Larsen; James J. Robnett, both of Portland, Oreg.

[73] Assignee: Raygo Wagner, Inc., Portland, Oreg.

[22] Filed: Jan. 26, 1976

[21] Appl. No.: 652,556

Related U.S. Application Data

[63] Continuation of Ser. No. 474,618, May 30, 1974, abandoned.

[52] U.S. Cl. ..... 214/147 G; 212/9; 212/42

[51] Int. Cl.[2] ..... B66C 23/00

[58] Field of Search ..... 212/8, 9, 40–44, 212/66; 214/77, 620, 730, 731, 147 G, 1 BC; 294/67; 91/411 R; 74/128, 51, 519

[56] References Cited

UNITED STATES PATENTS

| | | | |
|---|---|---|---|
| 3,487,964 | 1/1970 | Riley | 212/44 |
| 3,498,473 | 3/1970 | Spaulding et al. | 212/41 |
| 3,589,540 | 6/1971 | Kinross | 214/730 |
| 3,730,365 | 5/1973 | Herpich et al. | 214/302 |
| 3,764,032 | 10/1973 | Ward | 214/730 |

FOREIGN PATENTS OR APPLICATIONS

| | | | |
|---|---|---|---|
| 1,557,373 | 1/1969 | France | 294/67 DB |
| 1,902,465 | 8/1969 | Germany | 214/730 |

*Primary Examiner*—Frank E. Werner
*Assistant Examiner*—Lawrence J. Oresky
*Attorney, Agent, or Firm*—Klarquist, Sparkman, Campbell, Leigh, Hall & Whinston

[57] ABSTRACT

The load-lifting mechanism at the front of a lift truck carries a vertical boom with a forwardly cantilevered boom portion rotatably mounting a vertical pivot shaft at its forward end. The shaft suspends a rotatable carriage frame beneath the cantilevered boom portion. A larger pickup carriage frame with downwardly extending pickup arms is suspended by chains from the rotatable carriage frame. The upper ends of one pair of pickup arms are pivoted for limited movement transversely of the longitudinal axis of the carriage frames and for upwardly swinging movement to positions alongside the carriage frames. Fluid cylinders on the rotatable frame adjust the pickup frame for side shifting, end shifting, transverse sloping and longitudinal sloping movement. A rotation mechanism for rotating the pivot shaft and thus both of the suspended carriage frames and their load includes a first fluid cylinder connected between the cantilever boom and a floating lever rotatably mounted on the pivot shaft and a second fluid cylinder connected between the floating lever and a second lever fixed to the shaft. Stroking of these cylinders rotates the shaft and thus the carriage frames and their load through more than 180° in opposite directions about the vertical axis of the shaft.

4 Claims, 5 Drawing Figures

LIFT TRUCK WITH ROTATABLE LOAD-HANDLING APPARATUS

RELATED INVENTIONS

This is a continuation of our prior application, Ser. No. 474,618, filed May 30, 1974 now abandoned.

BACKGROUND OF THE INVENTION

1. Field of the Invention

The present invention relates to lift trucks and more particularly to a lift truck having a horizontally rotatable load-handling apparatus.

2. Description of the Prior Art

There is no load-lifting apparatus known to be available that is adapted for use with conventional lift trucks and capable of rotating large, heavy containerized loads or other similarly large objects through a substantial arc of at least 180° about a vertical axis.

The need for such an apparatus has arisen because of the recent development of a system of shipping automobiles inside large containers to prevent damages to the automobiles while in transit from theft, vandalism and natural hazards. Each such container has one open end and contains three automobiles. Several such containers are loaded close together end-to-end on a railroad flatcar with their open ends being adjacent to an end of an adjoining container so as to be inaccessible. When the flatcars reach their destination, the containers are lifted therefrom and placed on the ground ready for unloading. If stored for any length of time on the ground, such containers again may be placed close together with their open ends unexposed and inaccessible.

In the loading, unloading and general handling of such containers, large heavy-duty lift trucks are used. The work of such trucks would be greatly simplified if their load-lifting apparatus could rotate the containers through at least 180° because of the frequent need to reverse the containers end-for-end for proper positioning of the containers. With such a rotatable apparatus the open ends of the containers could be easily oriented with respect to machines used for inserting automobiles into and extracting automobiles from the containers, for loading the containers on flatcars and for placing the containers in storage positions without the need for excessive maneuvering of the lift truck itself.

There are presently load carriages available for use with lift trucks capable of limited pivoting movement of a load through an arc of about 10° about a vertical axis. However, such carriages would obviously not be suitable for the foregoing-described purposes.

Although some prior patents suggest load-handling apparatus for vehicles capable of rotating loads about a vertical axis, such apparatus either requires a special-purpose vehicle or provides for rotation through only a limited arc of considerably less than 180° or would obviously not be adapted to handle large, heavy container-sized loads. Still other prior patents suggest such rotatable load-handling apparatus for lift trucks, but without clearly disclosing the nature of the rotating mechanism intended to be used. The closest known prior patents disclosing such apparatus are U.S. Pat. Nos. 2,620,930; 2,699,879; 3,003,206; and 3,638,810.

In the prior art, a common means of turning a shaft or other mechanism is through the use of a hydraulic, air or electric motor coupled with a gear, belt or chain drive reducer. This means has two disadvantages for the intended application. First, such a rotating unit powerful enough to turn and stop the heavy loads that are involved would be too expensive. Second, precise positioning of a load with such means is difficult to achieve.

Accordingly, in the design of a suitable rotatable apparatus to meet the previously described needs, it is desirable to use fluid-powered cylinders to achieve the desired rotational movement. Fluid power is readily available from lift trucks, and fluid cylinders can develop high turning forces for their size and weight as compared to other motors. Furthermore, precise positioning control is possible with fluid cylinders, and cylinder-operated mechanisms are usually easy to service. However, in the known state of the art, fluid cylinder operated mechanisms are not capable of pivoting a shaft in opposite directions through more than about 100°, which is insufficient for the application proposed.

Thus there is a need for a fluid cylinder operated mechanism capable of rotating a load-handling apparatus of a lift truck in opposite directions through at least 180°. Moreover there is a need for a load-handling apparatus with such a rotation mechanism that is adapted for use with conventional lift trucks and that is capable of handling container-size heavy loads.

SUMMARY OF THE INVENTION

The present invention fulfills the foregoing needs by providing a fluid cylinder operated mechanism for rotating a container-handling apparatus and thus heavy loads of conventional heavy-duty lift trucks in opposite directions through more than 180° and up to 200° about a vertical axis.

The fluid cylinder operated mechanism of the invention includes two fluid cylinders and two levers to turn a pivot shaft about its axis. One of the levers is floatingly connected to the shaft and the other lever is fixed to the shaft. One cylinder is connected between a base structure and the floating lever, and the other cylinder is connected between the floating lever and the fixed lever.

The invention also includes the incorporation of the previously described rotation mechanism in an overhead load-handling apparatus adapted to be supported by the load-lifting portion of a lift truck. The rotation mechanism, including the pivot shaft, is carried by an upper supporting portion of the apparatus, and a load pickup portion of the apparatus is suspended beneath the supporting portion and rotated by the pivot shaft.

The invention also includes the combination of a cylinder-operated rotation mechanism with cylinder-operated side-shifting, fore-aft shifting and slope or tilt control mechanisms in a load-handling carriage for precise positioning of the carriage and a supported load.

A primary object of the invention is to provide a fluid cylinder operated rotation mechanism capable of pivoting a load in opposite directions through 180° or more.

Another object is to provide a rotation mechanism as aforesaid capable of precise positioning of a load at any point along its arc of rotation.

Another object is to provide a rotation mechanism capable of developing high turning forces and yet being compact, simple, lightweight, inexpensive, and easy to control and maintain.

Another object is to provide a load-handling apparatus for a lift truck capable of lifting and rotating large, heavy loads through at least 180° about a vertical pivot axis.

Another object is to provide a load-handling apparatus as aforesaid adapted for attachment to conventional mast or boom-equipped lift trucks.

Another object is to provide a load-handling apparatus as aforesaid for use in handling truck and railcar containers.

Another object is to provide a load-handling apparatus for lift trucks capable of rotating the load carriage through 180° about a vertical axis, shifting the load carriage fore and aft with respect to the truck, shifting the load carriage side-to-side and sloping or tilting the load carriage with respect to a vertical or horizontal reference plane for precise positioning of the carriage and load.

The foregoing and other objects, features and advantages of the present invention will become more apparent from the following detailed description, which proceeds with reference to the accompanying drawings.

DETAILED DESCRIPTION

General Arrangement

Figure 1:
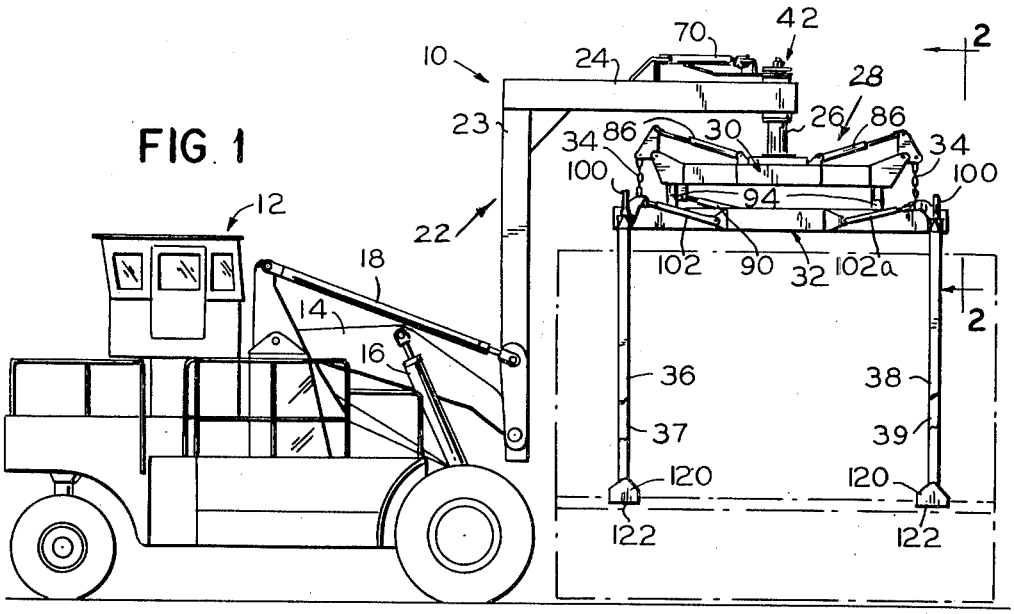
FIG. 1 is a side elevational view of a lift truck mounting a rotatable container-handling apparatus in accordance with the invention.

Referring to FIG. 1 of the drawings, a load-lifting apparatus 10 in accordance with the invention is supported by the load-lifting mechanism of a pneumatic-tired lift truck 12 designed to lift heavy loads. A lift truck of the type shown is of conventional design and includes a lift boom 14 pivoted at its rear end to the chassis of the truck. Hydraulic lift cylinders 16 raise and lower the boom. Stabilizer arms 18 on the truck form a parallelogram linkage with the chassis, lift boom and the load-handling apparatus 10 supported by the boom. The stabilizer arms comprise a pair of hydraulic cylinders which, when extended or retracted, allow the stabilizer arms to tilt the load-handling apparatus forwardly or rearwardly with respect to a vertical plane at the forward end of the lift boom.

In the illustrated embodiment, the load-handling apparatus or assembly includes a tall inverted L-shaped boom 22 including a vertical boom portion 23 and a cantilever boom portion 24 projecting forwardly generally horizontally from the upper end of the vertical boom portion. A vertical pivot shaft means 26 rotatably mounted in a forward end portion of cantilever boom 24 extends downwardly therefrom to rigidly secure at its lower end a load carriage assembly means 28. The load carriage assembly includes an intermediate rectangular rotatable carriage frame 30 supported directly by the pivot shaft 26 and a larger, lower rectangular load pickup carriage frame 32 suspended from the rotatable carriage frame 30 by flexible suspension means in the form of chains 34 extending downwardly from the four corners of the rotatable carriage frame. Four load pickup arms 36, 37, 38, 39 extend downwardly from the four corners of the pickup carriage frame for engaging a load to be lifted.

The described load-handling apparatus is attached to the lift truck 12 through pivotal connections of the forward ends of the lift boom 14 and stabilizer arm cylinders 18 with the vertical boom portion 23 of the apparatus.

The vertical pivot shaft 26 has an upward extension above the cantilever boom 24 to which a rotation mechanism 42 is connected for rotating the pivot shaft and thus the entire carriage assembly 28 therebelow about the vertical axis of the shaft to enable rotation of a load held by the pickup arms.

ROTATION MECHANISM

Figures 3, 4, 5:
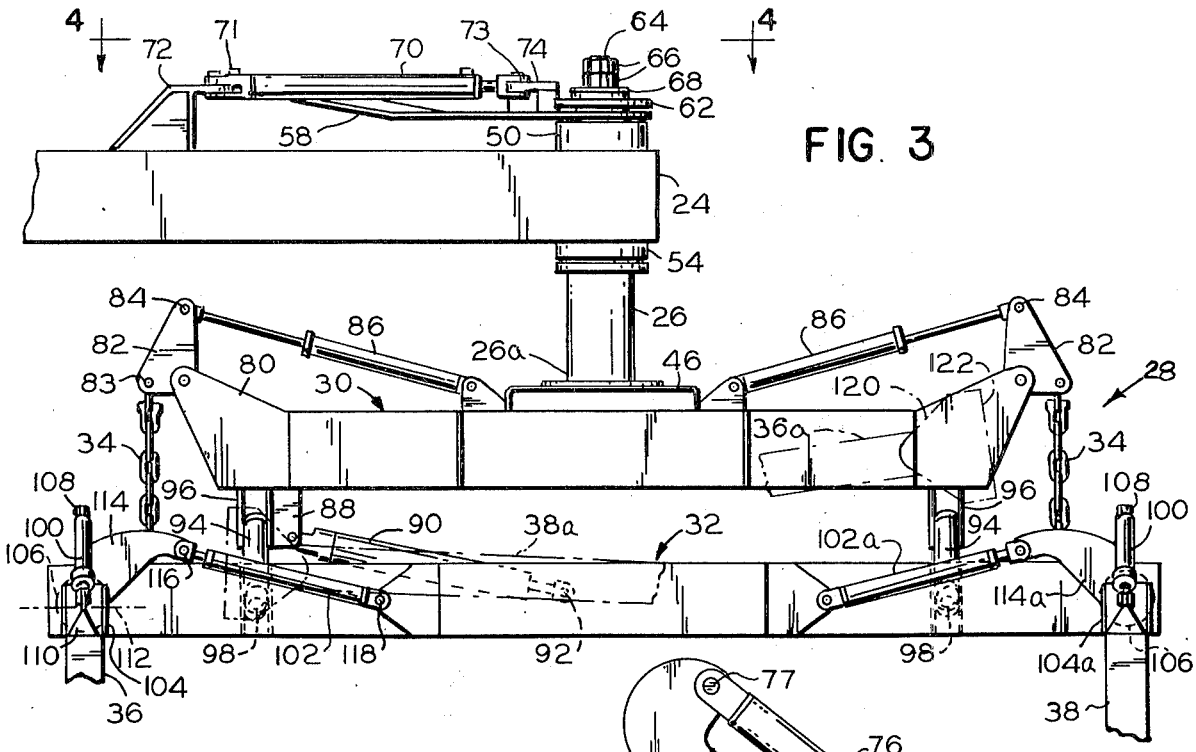
FIG. 3 is a side elevational view of the load-handling apparatus as viewed along the line 3—3 of FIG. 2.
FIG. 4 is a plan view of the rotation mechanism of the apparatus as viewed along the line 4—4 of FIG. 3.
FIG. 5 is a vertical sectional view of the rotating mechanism taken along the line 5—5 of FIG. 4.

Referring especially to FIGS. 4 and 5, rotation mechanism 42 is fluid cylinder operated. Pivot shaft 26 is rotatably mounted within an opening 44 at the forward end of cantilever boom 24. Since the pivot shaft is designed to support extremely heavy loads, the shaft is of heavy composite construction as shown and includes a large diameter hollow lower shaft portion **26*a* rigidly connected at its lower end to a central frame portion 46 of rotatable carriage frame 30. An upper solid shaft portion 26*b* of shaft 26 extends within the upper end of hollow shaft portion 26*a* and is welded thereto. The upper shaft portion is rotatably supported by tapered roller bearings 48 within an annular bearing ring 50 seated within shaft opening 44 and attached to cantilever boom 24. Lower pivot shaft portion 26*a* is supported in annular bearings 52 carried by a second bearing ring 54 attached to cantilever boom 24 at the lower end of opening 44.**

A relatively long floating lever 58 with an outturned outer end is rotatably connected to the portion of pivot shaft 26 above cantilever boom 24 at annular bearing members 60, shown in FIG. 5. A second, shorter fixed lever 62 with a hooked outer end is affixed to an upper portion of the pivot shaft above floating lever 58 so as to rotate with the shaft. Fixed lever 62 extends outwardly from the pivot shaft at an acute angle with respect to the direction of extension of floating lever 58 from the same shaft. An upper threaded extension 64 of the pivot shaft receives nut members 66 and a washer 68 for retaining shaft, bearing and lever elements in place with respect to the pivot shaft.

A first fluid cylinder 70 is pinned at one end at 71 to a bracket 72 fixed to one side of cantilever boom 24. The opposite, rod end of cylinder 70 is pinned at 73 to a bracket 74 affixed to an intermediate portion of floating lever 58. A second fluid cylinder 76 having the same stroke as the first cylinder 70 is pinned at 77 at one end to the outturned end of floating lever 58 and at its opposite, rod end at 78 to the hooked end of fixed lever 62.

It will be apparent from FIG. 4 that extension of cylinder 70 rotates floating lever 58 clockwise about the vertical axis of pivot shaft 26. Since the floating lever is rotatably mounted on the shaft, normally such lever would not turn the shaft. However, because cylinder 76 is connected both to the floating lever and to fixed lever 62, rotation of the floating lever also causes rotation of the fixed lever to the same extent. Because the fixed lever is affixed to the pivot shaft, the shaft and its connected carriage frames also rotate upon extension of the cylinder 70. When cylinder 70 is fully extended, additional rotation of the pivot shaft in the same direction is achieved by extension of cylinder 76. Extension of cylinder 76 rotates fixed lever 62 clockwise relative to floating lever 58, thereby causing additional rotation of pivot shaft 26 and its connected carriage frames. Retraction of the cylinders causes rotation to the same extent in the opposite direction. In the cylinder and lever arrangement shown, cylinder 70 has the capability of rotating shaft 26 through an arc of approximately 95° in opposite directions, and cylinder 76 has the capability of rotating shaft 26 through an additional arc of 95°, for a total rotation capability of 190°. Moreover, through the use of appropriate hydraulic controls which are well known in the hydraulics field, the cylinders can be caused to stroke in sequence and to any desired extent for rotation of pivot shaft 26 and its connected carriage frames and load through any portion of the full arc of rotation for precise positioning of the load.

CARRIAGE FRAME DETAILS

Figure 2:
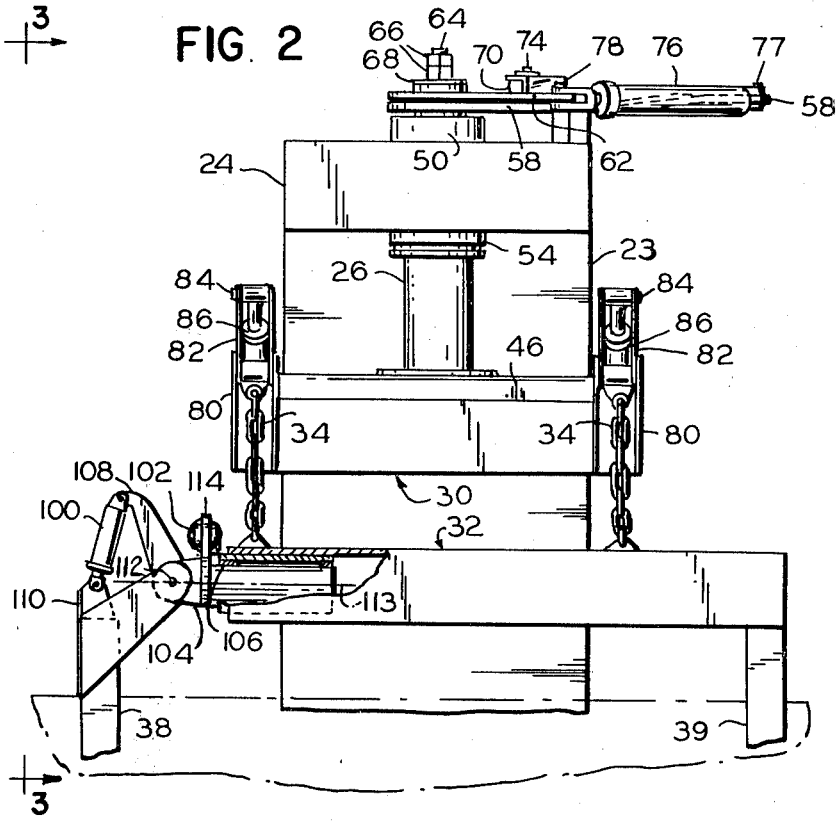
FIG. 2 is a front elevational view of the load-handling apparatus of FIG. 1 on an enlarged scale as viewed along the line 2—2 of FIG. 1.

With reference particularly to FIGS. 2 and 3, rotatable carriage frame 30 includes the central slightly raised frame portion 46 where the lower end of pivot shaft 26 is fixed to frame 30. Ears 80 at the four corners of carriage frame 30 pivotally mount bellcrank levers 82 from one corner of which at 83 the flexible suspension chains are suspended. Pinned at 84 to the other corner of each bellcrank lever 82 is the rod end of a hydraulic slope cylinder 86. By extension and retraction of the four individual float control cylinders 86, the level of pickup frame 32 below the rotatable frame 30 can be adjusted. Further, by independent control of the four cylinders 86, the slope or inclination of the pickup carriage frame can be adjusted with reference to a horizontal plane and with reference to the plane of the rotatable carriage frame, both from side-to-side and from end-to-end of the pickup frame.

In addition, a pair of brackets 88 depend from opposite corners of one end of rotatable carriage frame 30. A hydraulic end shift cylinder 90 is pinned at one end to each bracket 88 and at its opposite, rod end at 92 to an intermediate frame portion of the lower pickup carriage frame so that end shift cylinders 90 extend at an inclination between the two carriage frames. Through extension and retraction of end shift cylinders 90, the lower pickup carriage frame 32 can be shifted to a limited extent fore and aft with respect to the rotatable carriage frame for adjusting the positions of pickup arms 36–39 with respect to a load to be lifted and for shifting a supported load with respect to a supporting surface.

A similar pair of side shift cylinders 94 extend at an inclination between the two carriage frames for shifting the lower carriage frame sideways to a limited extent with respect to the rotatable intermediate carriage frame 30. This is again for final positioning of the pickup arms with respect to a load or a supported load with respect to a surface onto which the load is to be lowered. Each side shift cylinder 94 is supported at one end from a depending bracket 96 at a corner of one side of the rotatable carriage frame 30. The opposite, rod end of each such cylinder is connected at 98 to the lower pickup carriage frame 32.

From the foregoing description it will be apparent that the various side-shift, end-shift and slope cylinder means enable precision adjustment of the positions of the pickup arms and of a load in all directions to meet a wide variety of operating conditions.

As shown best in FIG. 2, the rear pair of pickup arms 37, 39 closest to truck 12 are fixed in depending relationship to the lower carriage frame 32. However, the forward pair of arms 36, 38 are pivoted to the forward corners of the lower carriage frame, both for limited pivoting movement toward and away from the opposing pair of fixed legs for engaging a load and for upward swinging movement alongside the carriage frames for clearing a load. With reference to arm 36 in FIG. 3, each pivoted pickup arm 36, 38 includes a pair of actuating cylinders including a load-engaging hydraulic cylinder 100 and a hydraulic swing cylinder 102. Arm 36 is pivoted to a knuckle 104 for movement about a longitudinal horizontal axis 112, and the knuckle in turn is rotatably journaled at 106 in the forward corner of the lower frame for swinging movement about a horizontal transverse axis 113 (FIG. 2). Load-engaging cylinder 100 is pinned at one end to an upwardly extending arm 108 fixed to knuckle 104. The opposite, rod end of such cylinder is pinned to a lever projection 110 at the upper end of arm 36 so that stroking of cylinder 100 causes a limited pivoting movement of the arm in and out about axis 112.

Knuckle 104 has an upwardly inclined lever arm 114 to the outer end of which the rod end of swing cylinder 102 is pinned at 116. The opposite end of cylinder 102 is pinned at 118 to a side frame member of lower pickup carriage frame 32. Thus extension of swing cylinder 102 causes an inward and upward swinging movement of pickup arm 36 to a position indicated at **36*a* alongside the two carriage frames. The construction of the pivot mounting for pickup arm 38 is similar to that described for pickup arm 36. However, the corresponding lever arm 114*a* of knuckle 104*a* for pickup arm 38 is inclined upwardly at a greater angle than lever arm 114 so that extension of swing cylinder 102*a* for arm 38 causes such arm to swing upwardly to a retracted position 38*a* which is below and forwardly of the retracted position 36*a* of pickup arm 36.**

The lower end of each pickup arm 36–39 has an enlarged foot 120 with an inwardly extending load-engaging flange 122 for entering a socket or engaging a flange or shoulder or other lifting element at opposite sides of a container or other load to be lifted.

OPERATION

In operation the lift truck would normally approach a container to be lifted with the carriage frames rotated 90° from the position shown in FIG. 1 and with the pivoted pickup arm forward. For appropriate positioning of the pickup frame and arms in this regard, rotation mechanism 42 is activated. Also, to enable the lift truck to approach the side of a container and project the carriage frame over the top of such container, swing cylinders **102, 102*a* are extended to swing forward pickup arms 36, 38** to positions alongside the carriage frames.

When the carriage frames are positioned directly over the top of the container, swing cylinders **102, 102*a* are retracted to lower forward pickup arms 36, 38 to vertical positions along the forward side of the container. Any final alignment of the load-engaging flanges of the pickup arms with the lifting means on the container is accomplished through operation of either the appropriate slope control cylinders 86, side shift cylinders 94, or end shift cylinders 90 as required. With the load-engaging flanges of the pickup arms properly aligned, the lift truck is driven forwardly toward the container until the flanges of the rear, fixed arms engage the lift means on the rear side of the container. Then load-engaging cylinders 100 of forward pickup arms 36, 38 are extended until the pickup flanges of the forward arms engage the lift means on the front side of the container. Thereafter the container is lifted to the desired level by raising lift boom 14 of the truck through extension of lift cylinders 16.** Assuming that the container was lifted from ground level and is to be placed on a flatcar, the truck is driven to a position alongside and facing the flatcar in position for lowering the container onto the car.

Now, assuming that the container contains automobiles as previously described and has an open end which it is desired to position closely adjacent to an end of a second automobile container already on the flatcar, it may be necessary to reverse the ends of the lifted container 180° more or less. To accomplish this, cylinders 70, 76 of the rotation mechanism arm are extended or retracted as required to operate the floating and fixed levers 58, 62, respectively, and thus rotate pivot shaft 26 and the carriage frames and container supported thereby.

When the desired rotation is achieved, the supported container can be lowered onto the flatcar next to the previously loaded container through lowering of the lift boom of the truck. Any final leveling of the container necessary before lowering it to the flatcar surface can be accomplished through actuation of the appropriate slope control cylinders 86. Final positioning of the open end of the supported container closely adjacent to an end of the previously positioned container can be achieved through extension of end shift cylinders 90, followed by a final lowering of the container onto the flatcar surface.

Thereafter, the container is released from the pickup arms by retraction of cylinders 100 followed by extension of swing cylinders 102, 102*a* until the forward pickup arms clear the top of the cylinder. Thereafter the lift truck is backed away from the flatcar to disengage the rear arms from the container. For unloading a container from the flatcar, the procedure would be reversed.

In the foregoing description only one application of the rotation mechanism has been described. It will be obvious, however, to those skilled in the art that such mechanism has numerous other applications, wherever rotation of a shaft or load through a substantial arc in opposite directions is desired. Also, although the rotation mechanism is shown applied to one specific type of load-handling apparatus, such mechanism has broad application to many other types of load-handling apparatus, particularly to vehicle-mounted load-handling apparatus, and particularly where rotation of a load carriage about a vertical axis is desired.

Having illustrated and described what is presently a preferred embodiment of the invention and a preferred application thereof, it will be apparent to those skilled in the art that the same permits of modification in arrangement, detail and application. We claim as our invention all such modifications coming within the true spirit and scope of the following claims.

We claim:

1. In a lift truck having a load-lifting mechanism at its forward end for handling heavy loads, a boom means for attachment to said load-lifting mechanism including a generally horizontally disposed boom portion forwardly of said truck, a load carriage means spaced vertically below said boom portion, a vertical pivot shaft means rotatably supported by said boom portion and extending downwardly therefrom, a lower portion of said pivot shaft means being affixed to said carriage means to suspend and rotatably support said load carriage means below said boom portion, and fluid cylinder operated rotation means carried by said boom portion and connected to said pivot shaft means for pivoting said shaft means in opposite directions about the vertical axis thereof through an arc of at least 180° and thereby pivoting said load carriage means and any load carried thereby to the same extent, said fluid cylinder operated rotation means includes a first floating lever rotatably connected to said pivot shaft means, a first fluid cylinder connected at one end to said boom means, a first fluid cylinder connected at one end to said boom portion and at its other end to said floating lever for rotating said floating lever about said pivot shaft means through at least about 90° in opposite directions, a second fixed lever affixed to said pivot shaft means for rotation therewith, and a second fluid cylinder connected at one end to said floating lever and at its other end to said fixed lever for pivoting said fixed lever through at least about 90° in opposite directions, whereby extension of said first cylinder causes rotation of said floating and fixed levers and thus said pivot shaft means through at least about 90° in one direction about the vertical axis of said shaft means and extension of said second cylinder causes rotation of said fixed lever relative to said floating lever and thus said shaft means at least about an additional 90° in the same said one direction, wherein said load carriage means includes a first horizontally disposed rotatable carriage frame suspended directly from said pivot shaft means to rotate therewith and a second horizontally disposed load pickup carriage frame spaced below said rotatable carriage frame, flexible suspension means suspending said pickup carriage frame from said rotatable carriage frame, and load pickup means carried by said pickup carriage frame, whereby operation of said rotation means to rotate said pivot shaft means causes rotation of said pickup carriage frame and any load supported thereby; said flexible suspension means includes a plurality of flexible members each are connected to a corresponding fluid cylinder operated slope adjustment means on said rotatable carriage frame for adjusting the slope of said pickup carriage frame at least laterally and longitudinally relative to said rotatable carriage frame.

2. Apparatus according to claim 1 including fluid powered cylinder means interconnecting said rotatable carriage frame and said pickup carriage frame and extending at an inclination therebetween, said cylinder means being operable to shift said pickup carriage frame transversely and longitudinally to limited extents relative to said rotatable carriage frame.

3. Apparatus according to claim 1 wherein said load carriage means includes load pickup arms extending downwardly therefrom on opposite sides of a longitudinal centerline thereof, said pickup arms on at least one side of said centerline being movable toward and away from said pickup arms on the opposite side thereof and said pickup arms on one side of said centerline being movable upwardly to the level of said carriage means to enable said carriage means to be projected horizontally over a load to be picked up.

4. Apparatus according to claim 2 wherein said pickup carriage frame is of generally rectangular form and wherein said pickup means includes pickup arms depending from the four corners of said pickup carriage frame, at least two of said arms on one side of said frame being pivoted at their upper ends for movement toward and away from opposed said arms on the opposite side of said pickup carriage frame and for swinging movement upwardly to a level to enable said pickup carriage frame to be projected horizontally over a load to be picked up, and fluid cylinder means on said pickup carriage frame for pivoting said two pivoted arms.

* * * * *